United States Patent [19]

Vermaat

[11] Patent Number: 4,673,027

[45] Date of Patent: Jun. 16, 1987

[54] DEVICE FOR INSPECTION AND/OR REPAIR OF THE TUBES OF A STEAM GENERATOR FOR NUCLEAR REACTORS

[75] Inventor: Huibrecht P. Vermaat, Rockanje, Netherlands

[73] Assignee: Brown Boveri Reaktor GmbH, Mannheim, Fed. Rep. of Germany

[21] Appl. No.: 385,922

[22] Filed: Jun. 7, 1982

[30] Foreign Application Priority Data

Jun. 6, 1981 [DE] Fed. Rep. of Germany ..... 3122660

[51] Int. Cl.[4] ..... B25J 9/04

[52] U.S. Cl. ..... 165/11.2; 165/76; 414/728; 414/744 R; 901/15; 901/41

[58] Field of Search ..... 165/11 A, 76; 414/1, 414/4, 8, 728, 744 R, 744 A, 749, 750; 901/1, 15, 16, 41

[56] References Cited

U.S. PATENT DOCUMENTS

| | | | |
|---|---|---|---|
| 3,913,752 | 10/1975 | Ward et al. | 165/76 |
| 3,964,293 | 6/1976 | Faure et al. | 414/749 |
| 4,205,939 | 6/1980 | Reyes | 165/11 A |
| 4,205,940 | 6/1980 | Golick | 414/744 R |
| 4,212,583 | 7/1980 | Gebelin | 414/750 |
| 4,216,893 | 8/1980 | Glatthom | 165/76 |
| 4,302,146 | 11/1981 | Finlayson et al. | 414/744 R |
| 4,363,592 | 12/1982 | Tedder | 414/728 |
| 4,425,296 | 1/1984 | Adamowski et al. | 165/11 A |
| 4,438,805 | 3/1984 | Gugel | 414/744 R |

FOREIGN PATENT DOCUMENTS

| | | | |
|---|---|---|---|
| 2852821 | 4/1980 | Fed. Rep. of Germany | 901/15 |
| 0136258 | 11/1978 | Japan | 901/15 |

*Primary Examiner*—William R. Cline
*Assistant Examiner*—John K. Ford
*Attorney, Agent, or Firm*—Herbert L. Lerner; Laurence A. Greenberg

[57] ABSTRACT

Device for inspection and repair of tubes of a nuclear reactor steam generator in a tube bundle being disposed in a tube sheet and opening into at least one chamber having an opening formed therein, including a manipulator being insertible in the chamber through the opening and being lockable to the tube sheet for carrying remotely controlled and monitored inspection instruments and tools, the manipulator including a support leg being adjustable in length in the axial direction, a main arm being connected to and movable relative to the support leg, and an equipment carrier being connected to the main arm and movable relative to and together with the main arm, and a mounting rod being connectible to and detachable from the manipulator.

5 Claims, 5 Drawing Figures

DEVICE FOR INSPECTION AND/OR REPAIR OF THE TUBES OF A STEAM GENERATOR FOR NUCLEAR REACTORS

The invention relates to a device for inspection and/or repair of the tubes of a steam generator for nuclear reactors which has at least one chamber, wherein a bundle of tubes set in a tube sheet open into the chamber, and a manipulator which carries remotely controlled and monitored inspection instruments and/or tools and can be locked to the tube sheet, and can be brought in through an opening in the steam generator.

The numerous tubes which are disposed inside a steam generator for nuclear power stations, must be checked at certain time intervals. To this end, eddy current probes, for instance, are introduced into the tubes from a steam generator chamber to obtain information regarding damage. The ends of the tube bundle open into the chamber through a tube sheet. Damaged tubes can then likewise be repaired or closed off by plugs from the steam generator chamber. To support the probes or tools and for positioning them, manipulators which are disposed inside the steam generator chamber are necessary. Since in nuclear power plants, the steam generator chamber is a zone of dangerous radioactivity, the manipulator should be constructed in such a way that no personnel need climb into this danger zone to bring the manipulator into or out of the steam generator chamber.

Such a manipulator is known from German Published, Non-Prosecuted Application DE-OS No. 28 26 106. The manipulator is held by spreading mandrels which extend into the tube ends. If a motion step is to be executed, a part of the spreading mandrels is removed, an arm of the manipulator is advanced one step and the spreading mandrels are reinserted. The control of the motion cycles is complicated. If the spreading mandrels fail, the manipulator crashes down since it is held by the mandrels alone. The manipulator is inserted into the steam generator chamber by a transporting unit which is used exclusively for this purpose. It can be supported only in the vicinity of the steam generator opening and also remains in the steam generator chamber during the checking operation.

It is accordingly an object of the invention to provide a device for inspection and/or repair of the tubes of a steam generator for nuclear reactors, which overcomes the hereinafore-mentioned disadvantages of the heretofore-known devices of this general type, having a manipulator of simple construction which requires only one fixation point at the tube sheet and from there scans the remaining area of the tube sheet. This is to relieve operating personnel of the necessity of entering the steam generator chamber.

With the foregoing and other objects in view there is provided, in accordance with the invention, a device for inspection and repair of tubes of a nuclear reactor steam generator in a tube bundle being disposed in a tube sheet and opening into at least one chamber having an opening formed therein, comprising a manipulator being insertible in the chamber through the opening and being lockable to the tube sheet for carrying remotely controlled and monitored inspection instruments and tools, the manipulator including a support leg being adjustable in length in the axial direction, a main arm being connected to and movable relative to the support leg, and an equipment carrier being connected to the main arm and movable relative to and together with the main arm, and a mounting rod being connectible to and detachable from the manipulator.

The manipulator is placed by hand in the steam generator chamber by means of the mounting rod by an operator stationed outside the chamber, and is fastened through the support leg. The mounting rod is disengaged, so that only the manipulator remains in the steam generator chamber. It is not necessary to repeatedly change the fastening of the manipulator.

In accordance with another feature of the invention, there is provided a coupler for connecting and disconnecting the main arm and support leg, another mounting rod being connectible to the support leg, the first-mentioned mounting rod being connectible to the main arm, and a track for guiding the main arm, the track being extended from the opening in the chamber to the support leg during connecting and disconnecting of the main arm and support leg.

This embodiment facilitates the installation since first, the support leg is put in place and then the main arm with the equipment carrier associated with it is put in place. The guide track and mounting rod are installation aids which do not remain in the steam generator chamber during the checking operation.

In accordance with a further feature of the invention, the coupler is part of a combined lifting and rotation drive for vertical and rotary motion of the main arm relative to the support leg.

In accordance with an added feature of the invention, there is provided a plug-in coupler connecting the mounting rod to the manipulator. In this way the connection can be released simply from outside the steam generator chamber.

In accordance with an additional feature of the invention, the steam generator chamber has a bottom with an inner surface, and the support leg is telescopically adjustable and includes a head being braced against the tube sheet and a base being braced against the inner surface of the chamber bottom.

In accordance with again another feature of the invention, there is provided a swivel joint connected between the main arm and the support leg, drive means for moving the main arm between a horizontal position and a position extended parallel to the mounting rod, a rotary drive for moving the equipment carrier into coincidence with the main arm, and another swivel joint connected in a lower portion of the support leg for moving the lower portion parallel to the mounting rod.

With this construction, the entire manipulator can be folded-up in a simple manner and inserted into and removed from the steam generator chamber through the opening.

To determine the position of the manipulator unambiguously, in accordance with a concomitant feature of the invention, there are provided drive elements for moving the support leg, main arm and equipment carrier, position indicators connected to the drive elements and to recording devices for motion cycles.

Other features which are considered as characteristic for the invention are set forth in the appended claims.

Although the invention as illustrated and described herein as embodied in a device for inspection and/or repair of the tubes of a steam generator for nuclear reactors, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
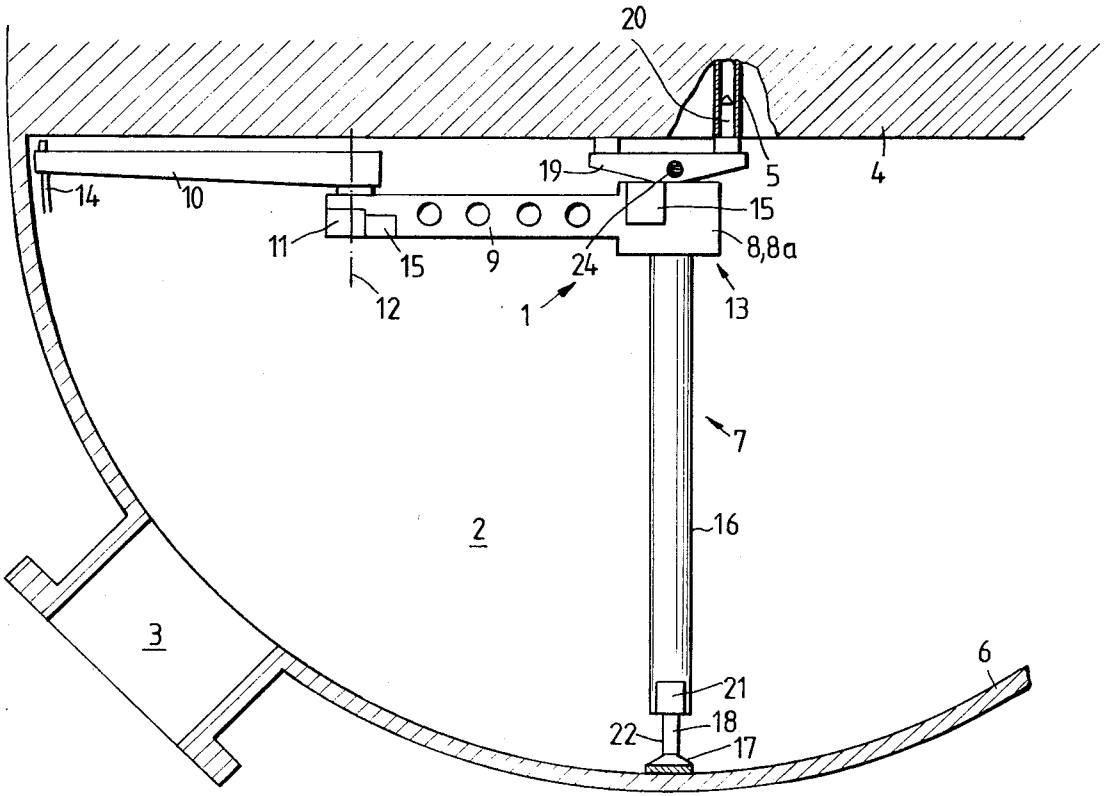
FIG. 1 is a fragmentary, diagrammatic, cross-sectional view, partially broken away, of a manipulator in the operating position.

Referring now to the figures of the drawing and first particularly to FIG. 1 thereof, there is seen a manipulator 1 during its employment in a steam generator chamber 2 which is provided with an opening 3 that will be referred to as a manhole. A large number of tubes 5 open into a tube sheet 4, which defines the chamber 2 along with a hemispherical bottom 6. Depending on the type of steam generator used, the hemispherical bottom 6 encloses a single chamber (in a straight tube steam generator) or two chambers when separated by a non-illustrated partition (in a U-tube steam generator). The manipulator 1 according to FIG. 1 is constructed in two parts which facilitates the insertion and removal into and out of the chamber 2. The manipulator 1 includes a support leg 7 and a main arm 9 connected thereto through a coupler 8, 8*a*. An equipment carrier 10 which can be moved parallel to the tube sheet 4 about an axis 12 by a drive element 11, is linked to the free end of the main arm 9. A combined lifting and rotation drive 13 of the hydraulic and/or mechanical type which is integral with the coupler part 8*a*, permits a rotary motion of the main arm 9 relative to the support leg 7 and/or combined with a rotary motion of the equipment carrier 10 relative to the main arm 9. The combined lifting and rotation drive 13 furthermore serves for the vertical motion of the main arm 9 along the support leg 7 for the purpose of the installation and removal operation of the manipulator, to be explained further on. Disposed at the free end of the equipment carrier 10, are guide elements 14 which are not shown in detail, but serve for bringing the repair and testing tools to the tubes of the steam generator tube bundle to be checked. As a rule, the guide elements are flexible tubes which extend through the manhole and are brought up from outside the chamber. Through the relative motion of the main arm and the equipment carrier with respect to each other and the relative rotary motion of the main arm with respect to the support leg, almost the entire area of the tube sheet can be covered from a single position of the support leg. In practice, this means that in a tube sheet with 4000 tubes, only about 10 tubes cannot be checked with one and the same support leg position, because of the space required for centering the support leg. Position indicators 15, which are connected to a program-supported operating unit, permit accurate positioning of the testing or repair devices at the individual tubes of the tube sheet. The operating unit and other recording devices for movement cycles of the manipulator parts are disposed outside the chamber and are not shown. These allow automatic operation as well as manual control. The support leg 7 includes a tube 16, into which a rod 18 extends. The rod 18 is constructed in telescope-fashion or with a threaded spindle, and carries a base 17. A plate 19 which has two pins 20 for centering the support leg in two tubes 5 of the tube sheet 4, is fastened to the upper end of the tube. By means of a lifting drive 21 integral with the tube 16, the base and the tube 16 can be moved in the axial direction relative to each other. The base adapts itself to the curved bottom through the use of a swivel joint 22 between the rod 18 and the base 17.

Figure 2:
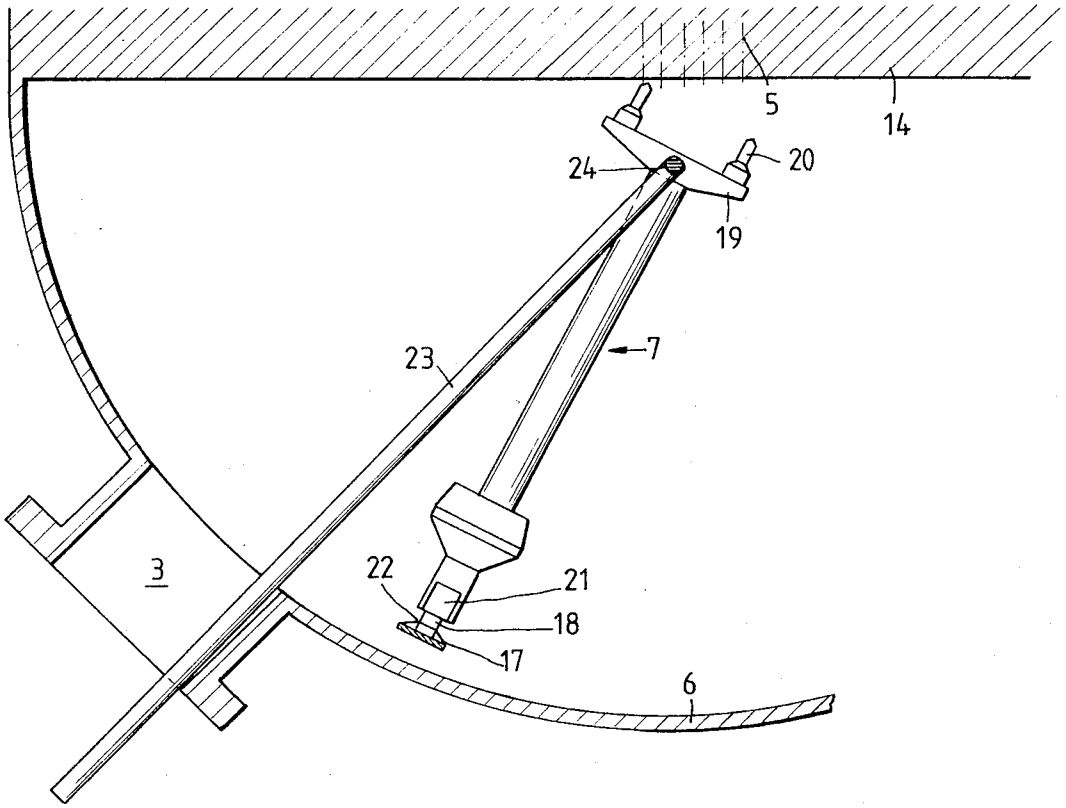
FIGS. 2 to 4 are views similar to FIG. 1 showing different installation steps for inserting and removing the manipulator according to FIG. 1, into and out of a steam generator chamber.
Figure 3:
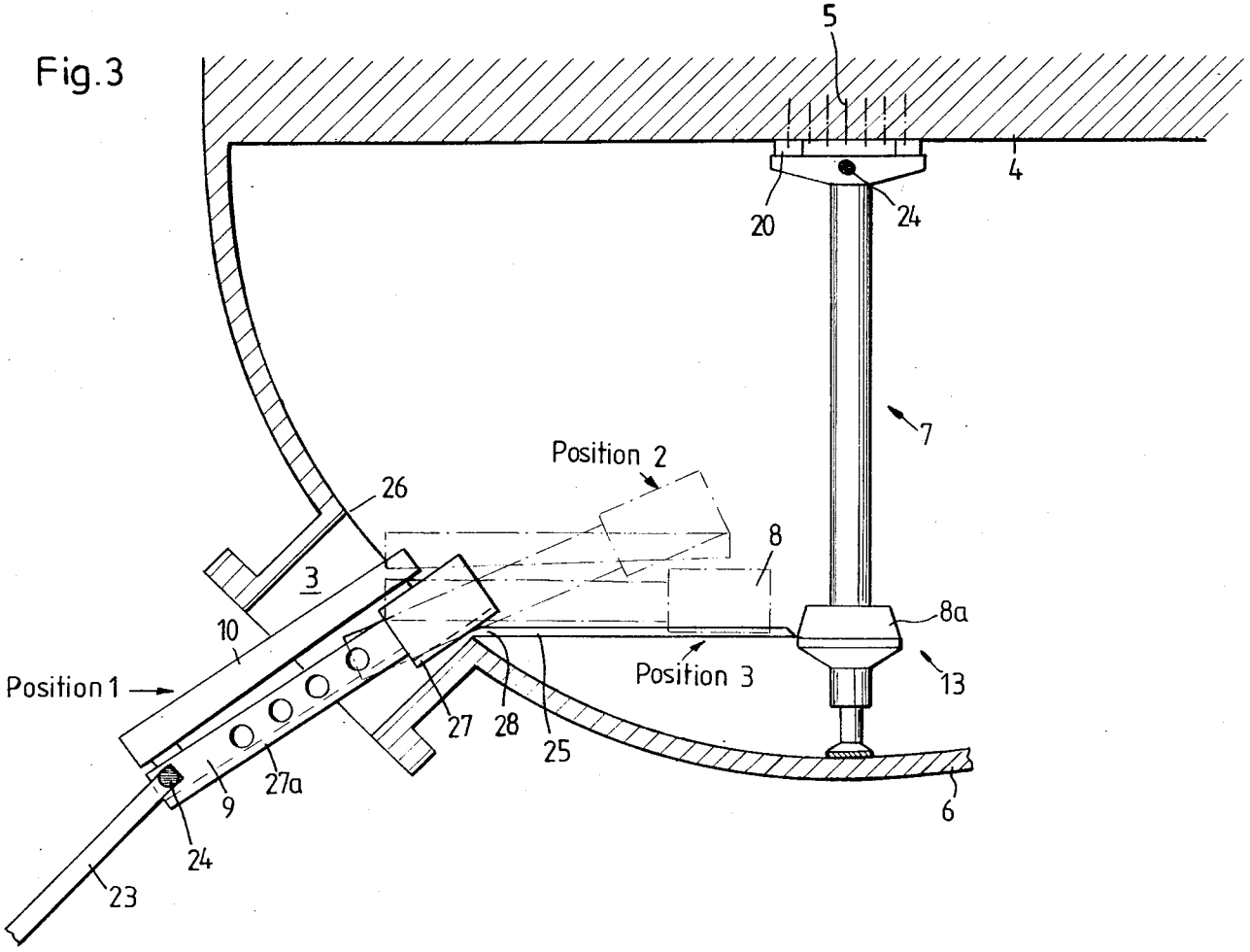
Figure 4:
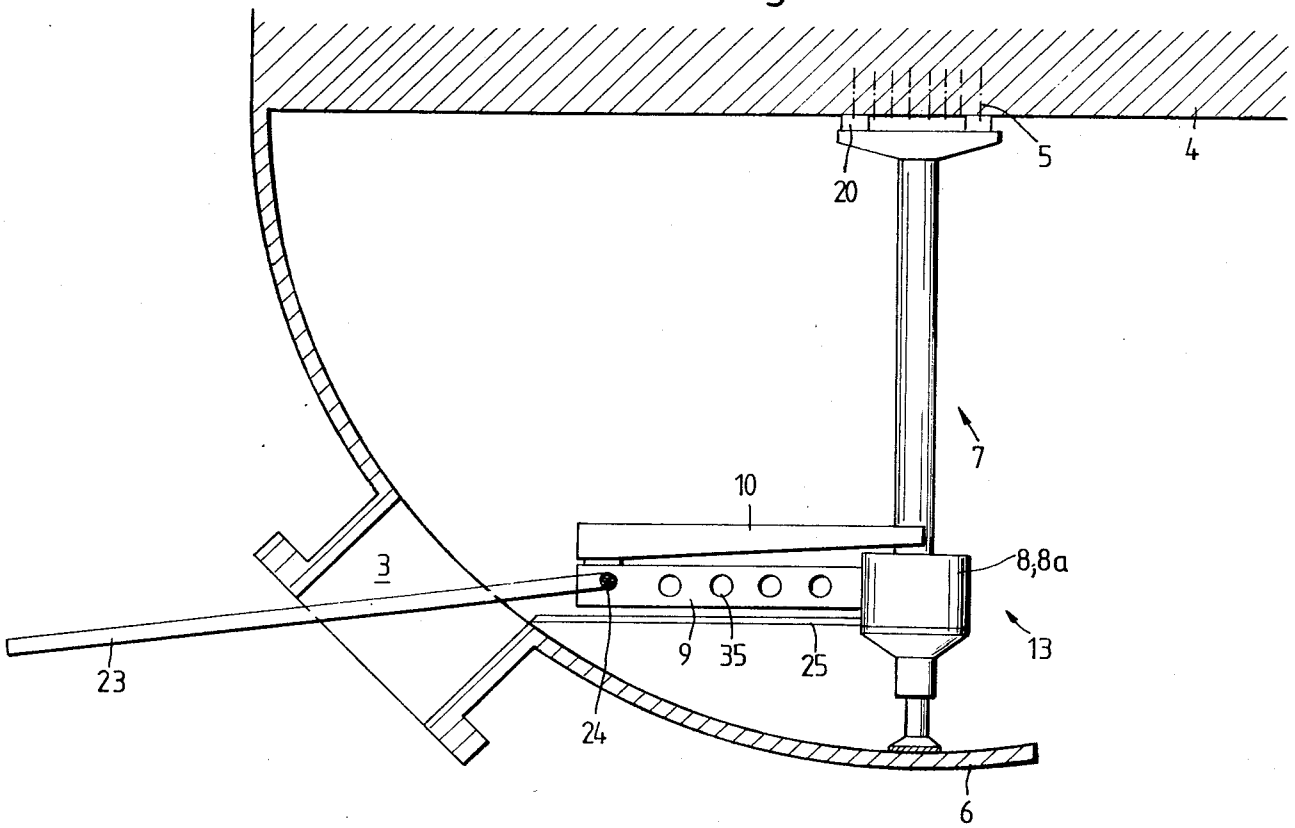

FIGS. 2 and 4 show the installation process of the support leg 7 and the main arm 9 with the equipment carrier 10 in step by step sequence. According to FIG. 2, the support leg is manually placed into the chamber 2 by a person standing outside the chamber by means of a mounting rod 23 which can be inserted into a swivel joint 24 disposed at the plate 19 of the support leg. The support leg is manipulated in such a way that the pins 20 can be inserted into two tubes 5 of the tube sheet 4 which are marked and clearly visible through the opening 3. In the vertical position which is then occupied, the rod 18 with the base 17 is downwardly pulled out of the leg 7 with the lifting drive 21 until contact with the bottom 6 is made. The mounting rod is subsequently detached and the installation of the support leg is completed. Thereupon, according to FIG. 3, one end of a guide track 25 is detachably connected to the housing of the combined lifting and rotation drive 13, and extends with its other end to the edge 26 of the opening 3. This is likewise done without entering the chamber 2. A mounting rod 23 is inserted into a swivel joint 24 of the main arm 9, which is constructed in a manner similar to that of the plate 19, in the position shown in FIG. 3. This is done after the main arm provided with a slot 27, 27*a* corresponding to the guide track has been first attached. The slot is provided on the underside of the coupler part 8 as well as along the bottom of the remaining main arm. With reference to FIG. 3, the main arm is thus guided first in the slot of the coupler part 8 (Position 1) and then is placed after further movement into the position 2 shown in dot-dash lines, where the slot 17*a* in the remaining part of the main arm 9 takes over the guidance together with the free end 28 of the guide track 25 until the slot in the coupler part 8 again assumes the guidance in accordance with position 3, also indicated in dot-dash lines. The main arm 9 together with the equipment carrier 10 then is placed into the joined position with the support leg 7, as shown in FIG. 4. The coupler part 8 of the main arm has entered in this case into a plug-in connection with the coupler part 8*a* integral with the combined lifting and rotation drive 13; it is easy to establish the connection and also easy to release. Then, the mounting rod 23 and the guide track 25 are removed, so that no installation aid remain inside the chamber 2 which could interfere with the operation of the manipulator. Together with the combined lifting and rotation drive 13, the main arm 9 with its equipment carrier 10 is run vertically upward to its measuring position. The checking or repair operation can then proceed in accordance with the program provided, since the support leg is locked with its pins 20 in marked tube positions and the program of the operating system takes these tube positions as reference points. The removal of the manipulator is logically accomplished in the reverse sequence.

Figure 5:
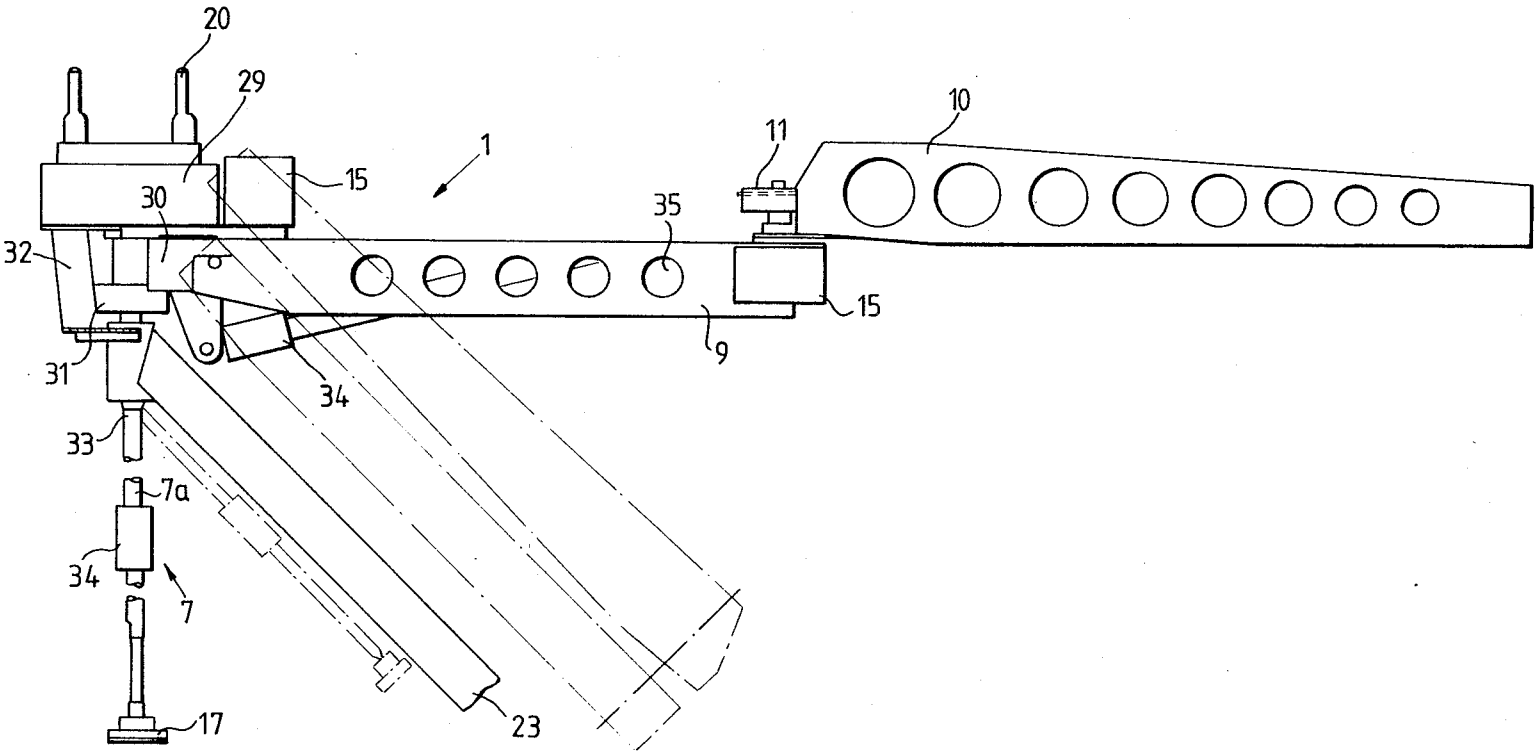
FIG. 5 is a diagrammatic elevational view showing another embodiment of a manipulator.

FIG. 5 shows a manipulator 1 which need not be disassembled into parts for installation in and removal from the chamber 2. In principle, the manipulator is constructed exactly like the one described in FIG. 1.

Differences as compared to the embodiment of FIG. 1, can be seen in that a rotary drive 29 is mounted to the support leg 7 and sets a bracket 30, which is guided between a shoulder 31 of the support leg 7 and the underside of the drive housing, in rotary motion about the axis of the support leg. The drive 29 is additionally supported at the support leg by a strut 32. The support leg is constructed for insertion and removal of the manipulator into and out of the chamber, which is not shown in FIG. 5. Therefore, the manipulator can be laid alongside the mounting rod 23 which is detachably fastened to the support leg. For this purpose, the lower part *7a* of the support leg can swing about a swivel joint 33. Likewise, the main arm 9, together with the equipment carrier 10 which is associated with it and can be rotated relative thereto by a drive element 11, can be brought into a position parallel to the mounting rod 23 by means of a swivel joint 15'. This purpose is served by a hydraulic cylinder 34 which is linked to a strut 30 and to the main arm 9. The folded-together position of the support leg and the main arm is indicated by dot-dash lines. Thus, the manipulator can be folded up in a simple manner and can be placed in the chamber opening through the opening 3 with the aid of the mounting rod. The support leg is again inserted into marked tube positions by the pins 20 at the tube sheet, and the lower part *7a* of the support leg which then swings into the vertical position is brought into contact with its base 27 at the bottom 6 of the chamber 2 by the hydraulic setting device 34. The mounting rod 23 is then removed. The main arm 9 is next brought into its horizontal measuring position by the hydraulic cylinder 34, and the equipment carrier 10 is brought into its testing or repair position. As in the embodiment described with reference to FIGS. 1 to 4, the position indicators 15 assigned to the drive elements aid in approaching the tubes 5 disposed in the tube sheet, with high positional accuracy, through programmable operating units. In the main arm 9 or the equipment carrier 10, holes 35 are provided for weight reduction.

Through the use of the invention, a manipulator has been created which can be employed, depending on the construction situation in the steam generator, in a one or two piece unit. The installation in and removal from the chamber 2, respectively, is simple and fast. It can be carried out easily by one person from outside the chamber by means of the installation aids. This considerably reduces the radiation exposure of the operating personnel, and a crash of the manipulator is impossible due to the use of the support leg.

I claim:

1. Device for inspection of a nuclear reactor steam generator having at least one chamber wherein a tube bundle held in a tube sheet terminates, the chamber being formed with an opening to the interior thereof and having a bottom spaced from the tube sheets, comprising a manipulator insertible through the opening into the chamber, said manipulator being formed of two separate parts, one of said parts being a support leg and having means for adjusting said support leg in length in axial direction thereof and for extending said support leg between the bottom of the chamber and the tube sheet, and the other of said parts being an arm and having means for connecting said arm at an end thereof to said support leg so as to be movable relative thereto and so as to extend parallel to the tube sheet, an equipment carrier connected to and movable together with said arm, and means for rotating said equipment carrier relative to said arm via a drive element, each of said parts being separately insertible into the chamber and having respective means for coupling said parts to one another, said support leg carrying a combined lifting and rotation drive having means for vertically and rotatingly displacing said arm relative to said support leg, said support leg and said arm having respective swivel joints formed with means for detachably connecting a respective mounting rod to said support leg and said arm for manually assembling the manipulator.

2. Device according to claim 1 including a track having means for guiding said arm between the opening of the chamber and said support leg during coupling of said arm and said support leg.

3. Device according to claim 1 wherein said support leg has a telescopic construction.

4. Device according to claim 1 including a plug-in coupler having means for detachably connecting said mounting rod to the respective swivel joint.

5. Device according to claim 1 wherein said means for coupling said arm and said support leg to one another are integrated in said combined lifting and rotation drive.

* * * * *